US006112881A

United States Patent [19]

Osti et al.

[11] Patent Number: 6,112,881

[45] **Date of Patent: *Sep. 5, 2000**

[54] PRODUCT CONVEYING ASSEMBLY

[75] Inventors: Roberto Osti, Zola Predosa; Fiorenzo Draghetti, Medicina, both of Italy

[73] Assignee: G. D. Societa' Per Azioni, Bologna, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/811,000

[22] Filed: Feb. 27, 1997

[30] Foreign Application Priority Data

Mar. 1, 1996 [IT] Italy ..... BO96A0098

[51] Int. Cl.[7] ..... B65G 29/00

[52] U.S. Cl. ..... 198/468.8; 198/468.2; 198/483.1

[58] Field of Search ..... 198/468.2, 468.8, 198/483.1

[56] References Cited

U.S. PATENT DOCUMENTS

| | | | |
|---|---|---|---|
| 3,802,547 | 4/1974 | Wagers, Jr. et al. | 198/483.1 X |
| 3,866,737 | 2/1975 | Simon | 198/483.1 X |
| 3,992,855 | 11/1976 | Palmieri et al. | 198/468.2 X |

FOREIGN PATENT DOCUMENTS

| | | | |
|---|---|---|---|
| 624498 | 5/1963 | Belgium . | |
| 174591 | 3/1986 | European Pat. Off. . | |
| 553636 | 8/1993 | European Pat. Off. . | |
| 275481 | 7/1998 | European Pat. Off. . | |
| 730190 | 5/1955 | United Kingdom | 198/483.1 |
| 2225564 | 6/1990 | United Kingdom . | |
| 2258441 | 2/1993 | United Kingdom | 198/483.1 |

*Primary Examiner*—Douglas Hess

*Attorney, Agent, or Firm*—Marshall, O'Toole, Gerstein, Murray & Borun

[57] ABSTRACT

A conveying assembly for conveying products, and having a conveying wheel for feeding a number of pockets in steps along a path extending through a loading and an unloading station having, respectively, a loading device and an unloading device, which in turn have respective push elements movable through the pockets and operated in push-pull manner with respect to each other, so as to perform a work stroke when the wheel is arrested, and a return stroke when the wheel is moving.

17 Claims, 4 Drawing Sheets

PRODUCT CONVEYING ASSEMBLY

BACKGROUND OF THE INVENTION

The present invention relates to a product conveying assembly.

The present invention is particularly advantageous for use on machines for packing relatively small products, such as cigarette packing machines, to which the following description refers purely by way of example.

Currently used packing machines are known to feature a conveying assembly comprising a pocket conveyor for feeding the products in steps along a given path extending between a loading station and an unloading station and through at least one work station where each product is manipulated between successive operating steps of the pocket conveyor.

Each product is normally loaded and unloaded by means of actuating devices normally comprising a pusher and a counter-pusher, and at least one of which performs a work stroke and a return stroke through each pocket when loading/unloading the product. The downtime during which the actuating devices engage each pocket at the loading and unloading stations therefore determines the hold time between successive operating steps of the pocket conveyor and, hence, the output capacity of the machine as a whole.

SUMMARY OF THE INVENTION

It is an object of the present invention to provide a conveying assembly of the above type, designed to minimize said downtime.

According to the present invention, there is provided a conveying assembly for conveying products, and comprising a conveyor having a number of pockets and moving in steps to feed said pockets along a path extending through a loading station and an unloading station for respectively loading and unloading said products; the assembly also comprising an unloading device and a loading device located respectively at the unloading station and the loading station, to transfer said products from and to said pockets; and the loading and unloading devices comprising respective push elements movable through said pockets, and respective actuating devices for imparting to said push elements a work stroke and a return stroke; characterized in that the actuating devices comprise respective drive means for moving the respective push elements back and forth along said path in the course of the respective return strokes, and for activating the push elements in push-pull manner with respect to each other, so as each to cause the respective push element to perform the respective work stroke when the conveyor is arrested between one step and the next, and the respective return stroke when the conveyor is moving.

Said path is preferably a path in the form of a loop, said push elements being located inside said loop.

According to a preferred embodiment of the above conveyor assembly, each said drive means comprises first actuating means for imparting to the respective push element a first movement in a first direction substantially crosswise to said path; and second actuating means for imparting to the respective push element a second movement in a second direction substantially parallel to said path.

According to the above preferred embodiment, the conveyor assembly comprises a fixed central frame; each said push element comprising a control rod; and said first and second actuating means of each said actuating device respectively comprising a first and second articulated transmission pivoting on said fixed frame and connected to separate points of the respective said rod.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
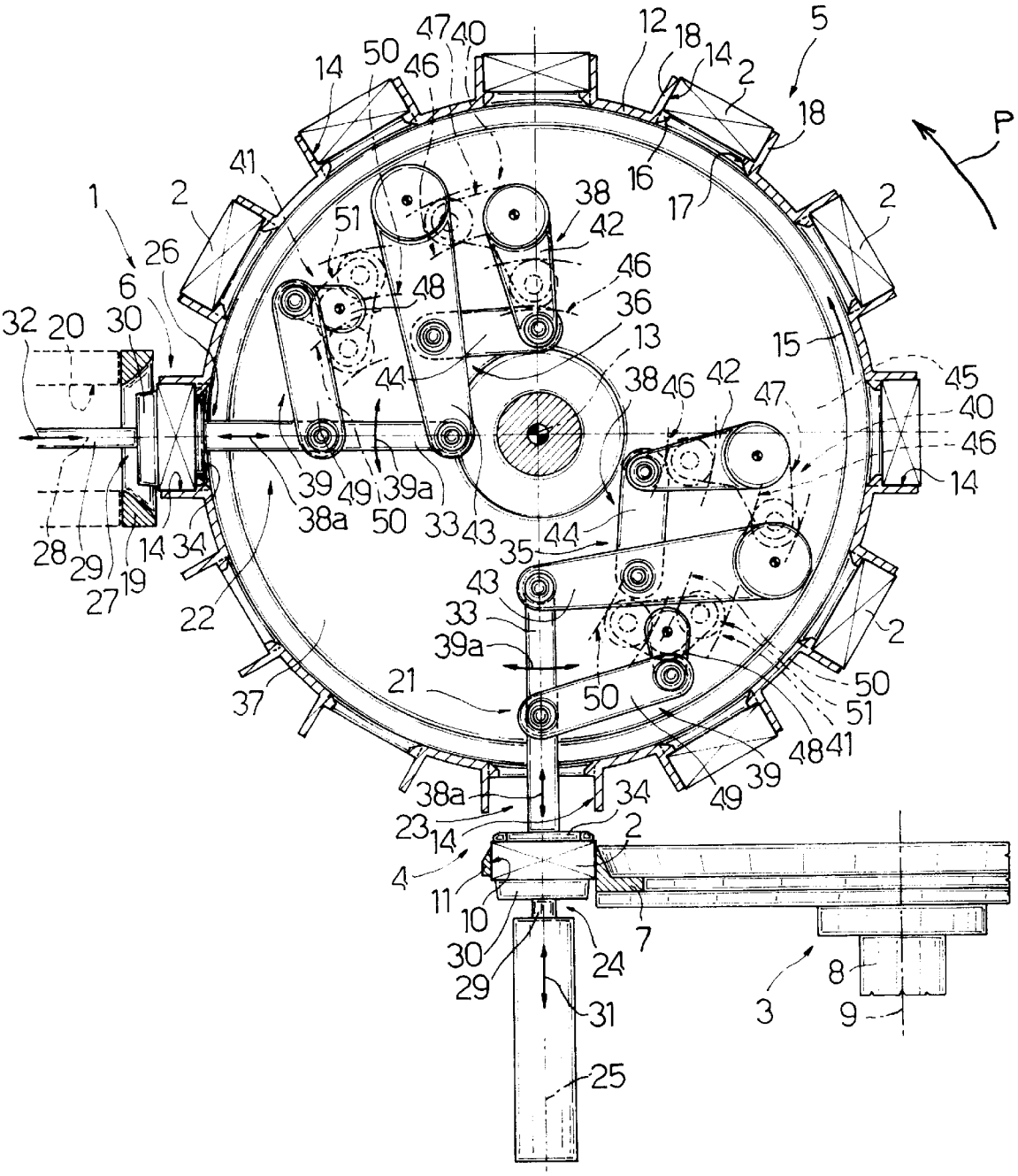
FIG. 1 shows a side view, with parts in section and parts removed for clarity, of a product conveying assembly in accordance with the teachings of the present invention and at a first operating stage.

Number 1 in the accompanying drawings indicates a machine for packing products 2, which, in the example shown, comprise respective groups of cigarettes wrapped in respective sheets of wrapping material. Machine 1 comprises a supply assembly 3 for successively feeding products 2 to a loading station 4; and a conveying assembly 5 for receiving products 2 at station 4 and transferring products 2 to an unloading station 6.

Supply assembly 3 comprises a supply wheel 7 fitted to a vertical drive shaft 8 to rotate in steps about an axis 9 coaxial with shaft 8, and which comprises a number of pockets 10 (only one shown) equally spaced about the periphery of wheel 7 and lying in a horizontal plane. Each pocket 10 is fed in steps by wheel 7 through loading station 4, and is defined by a substantially rectangular frame 11 surrounding a through seat for a respective product 2.

Conveying assembly 5 comprises a conveyor, in turn comprising a wheel 12, which is rotated in steps (anticlockwise in the drawings) about an axis 13 crosswise to axis 9, and has a number of conveying pockets 14 equally spaced about the outer periphery of wheel 12. Pockets 14 are fed in steps by wheel 12 in a direction 15 and along an annular path P extending through loading station 4 and unloading station 6, which is located downstream from station 4 in direction 15 and at a distance from station 4 equal to a whole number of operating steps of wheel 12.

Each pocket 14 is substantially U-shaped, and comprises a bottom wall 16 with a central opening 17, and two lateral walls 18 extending perpendicularly to wall 16 and outwards of wheel 12, which provides for simultaneously arresting a pocket 14 at station 4, in a position coaxial with a pocket 10 also arrested in station 4, and a further pocket 14 at station 6, in a position aligned with a substantially rectangular frame 19 defining the input of a fixed channel 20 in which to unload products 2.

Assembly 5 also comprises a loading device 21 located at station 4 and for successively transferring products 2 from respective pockets 10 to respective pockets 14; and an unloading device 22 located at station 6 and for feeding products 2 from respective pockets 14 into channel 20 through frame 19.

Loading device 21 comprises a push element, in turn comprising a counter-pusher 23, and a pusher 24, which, at each loading operation, are located along a radius 25 of wheel 12 parallel to axis 9, and respectively inside and outside path P, and cooperate with each other to transfer a product 2 into a stationary pocket 14 at station 4.

Unloading device 22 comprises a push element, in turn comprising a pusher 26, and a counter-pusher 27, which, at the end of each unloading operation, are located along a radius 28 of wheel 12 coaxial with channel 20, and respectively inside and outside path P, and cooperate with each other to transfer a product 2 from a respective stationary pocket 14 at station 6 into channel 20 through frame 19.

Pusher 24 and counter-pusher 27 each comprise an actuating rod 29 movable back and forth; and a plate 30 connected integrally to the end of rod 29 facing the periphery of wheel 12.

Plate 30 of pusher 24 is movable, by means of respective rod 29 and in a direction 31 coaxial with radius 25 and crosswise to path P, between a lowered idle position (shown in FIGS. 1, 3 and 4) in which plate 30 is positioned facing the end of a pocket 10 opposite the end facing the periphery of wheel 12, and a raised operating position (shown in FIG. 2) in which respective rod 29 extends through seat 10, and plate 30 is located at the input of a pocket 14 located at station 4 and aligned with pocket 10.

Plate 30 of counter-pusher 27 is movable, by means of respective rod 29 and in a direction 32 coaxial with radius 28 and crosswise to path P, between an extracted idle position (shown in FIG. 2) in which plate 30 is located inside channel 20, and a forward operating position (shown in FIG. 1) in which respective rod 29 extends through frame 19, and plate 30 is located at the input of a pocket 14 located at station 6 and aligned with frame 19.

Counter-pusher 23 and pusher 26 each comprise an actuating rod 33, and a plate 34 connected integrally to one end of rod 33, and are connected to respective actuating devices 35, 36, each connected to a respective rod 33.

Actuating device 35 of counter-pusher 23 provides for moving plate 34 of counter-pusher 23 between a withdrawn position (shown in FIGS. 2 and 3) in which plate 34 is located inside wheel 12, and an extracted position (shown in FIG. 1) in which plate 34 is positioned facing and adjacent to frame 11 of pocket 10 arrested in station 4, and respective rod 33 extends through pocket 14. The movement of counter-pusher 23 from the extracted to the withdrawn position defines a work stroke, and the movement of counter-pusher 23 from the withdrawn to the extracted position defines a return stroke.

Actuating device 36 of pusher 26 provides for moving plate 34 of pusher 26 between a withdrawn position (shown in FIG. 4) in which plate 34 is located inside wheel 12, and an extracted position (shown in FIG. 2) in which plate 34 is located inside channel 20, and respective rod 33 extends through pocket 14. The movement of pusher 26 from the withdrawn to the extracted position defines a work stroke, and the movement of pusher 26 from the extracted to the withdrawn position defines a return stroke.

Actuating devices 35 and 36 are identical, and both fitted inside wheel 12 to a frame comprising a fixed disk 37 housed inside wheel 12. Each actuating device 35, 36 comprises a first transmission, in turn comprising an articulated quadrilateral 38 hinged to the end of respective rod 33 opposite the end connected to respective plate 34; a second transmission, in turn comprising a connecting rod-crank element 39 hinged to an intermediate point of respective rod 33; and two drive devices 40, 41 for respectively controlling quadrilateral 38 and element 39. Drive device 40 so controls quadrilateral 38 as to move respective plate 34 substantially in a direction 38*a* crosswise to path P and axial with respect to respective rod 33; and drive device 41 so controls element 39 as to move respective plate 34 substantially in a direction 39*a* parallel to path P and crosswise to respective rod 33.

Quadrilateral 38 comprises a frame defined by disk 37; a crank 42 and a rocker arm 43, both pivoting at one end on disk 37; and a connecting rod 44 connecting the free end of crank 42 to an intermediate point of rocker arm 43, the free end of which is hinged to the end of rod 33 opposite the end fitted with plate 34. Drive device 40 controls the angular position of crank 42 with respect to disk 37, and comprises a cam disk 45 parallel to and facing wheel 12, and which rotates about axis 13 in direction 15 at a substantially constant angular speed equal to the average angular speed of wheel 12. Drive device 40 also comprises a number of annular tracks 46 formed about axis 13 on the surface of disk 45, and a positive tappet 47 connected to tracks 46 and angularly integral with crank 42.

Connecting rod-crank element 39 comprises a crank 48 pivoting at one end on disk 37; and a connecting rod 49 hinged at one end to the free end of crank 48, and at the other end to an intermediate point of rod 33. Drive device 41 controls the angular position of crank 48 with respect to disk 37, shares cam disk 45 with drive device 40, and comprises a number of annular tracks 50 formed about axis 13 on the surface of disk 45, and a positive tappet 51 connected to tracks 50 and angularly integral with crank 48.

The cam disc 45 rotates about axis 13 coaxially with wheel 12, with a given motion which is a function of ht emotion of the wheel 12. Each crank 42, 43 is hinged on the fixed disc 37 and has two arms with respective cam followers which are guided by respective cam profiles. The rotation of the cranks are determined by the paths of the cam profiles, which are illustrated in phantom in the Figures to show an exemplary pattern. The use of a cam disc 45 is generally known in the art, and one skilled in the art will appreciate how to design cam profiles to control a crank arm hinged to a fixed body.

The articulated quadrilateral 38 is reciprocated by crank 42 and comprises the rocker arm 43, the distal end of which is connected to rod 33. The rod 33 is reciprocated substantially in the direction 38*a*. The motion of the rod is not precisely in the direction 38*a*, because the distal end of the rocker arm 43 is reciprocated along an arc of a circle. Because the arc subtends an angle of only a few degrees, the motion of rod 33 is described herein as translation in the direction 38*a*.

Connecting rod 49 is moved by the respective crank arm 48 and rotates the rod 33 about the hinge connected the rod 33 to the rocker arm 43. Direction 39 is only substantially parallel to the path of wheel 12, because the hinge is not coincident with axis 13 of the wheel. Also, in this case, the oscillation of rod 33 subtends an angle of a few degrees, and direction 39*a* is substantially parallel to path P.

Each actuating device 35, 36 is operated by two cranks 42, 48. The crank 42 commands the substantially radial displacement of the plate 34, whereas the crank 48 commands a substantially circumferential displacement of the plate 34.

Figure 3:
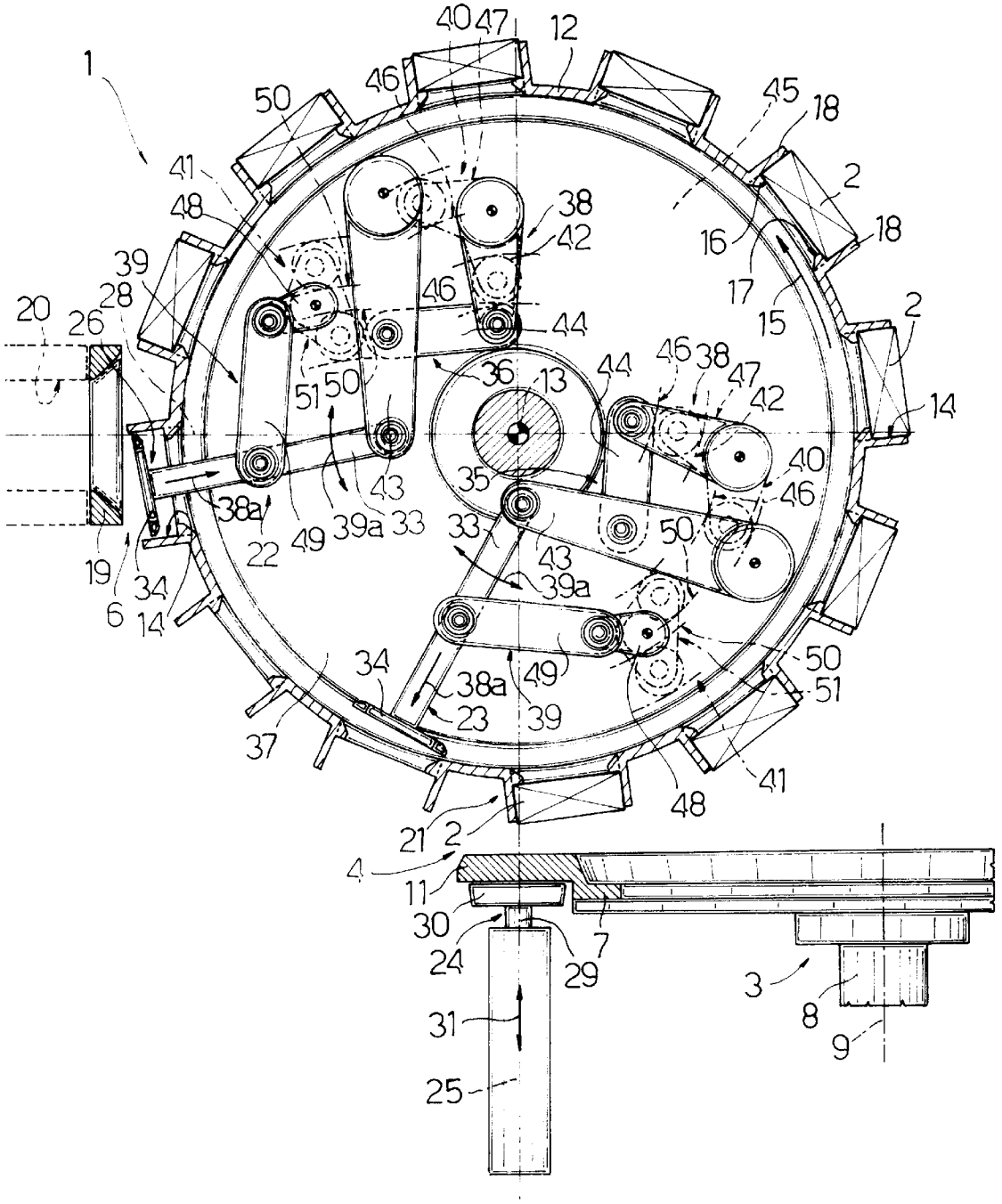
Figure 4:
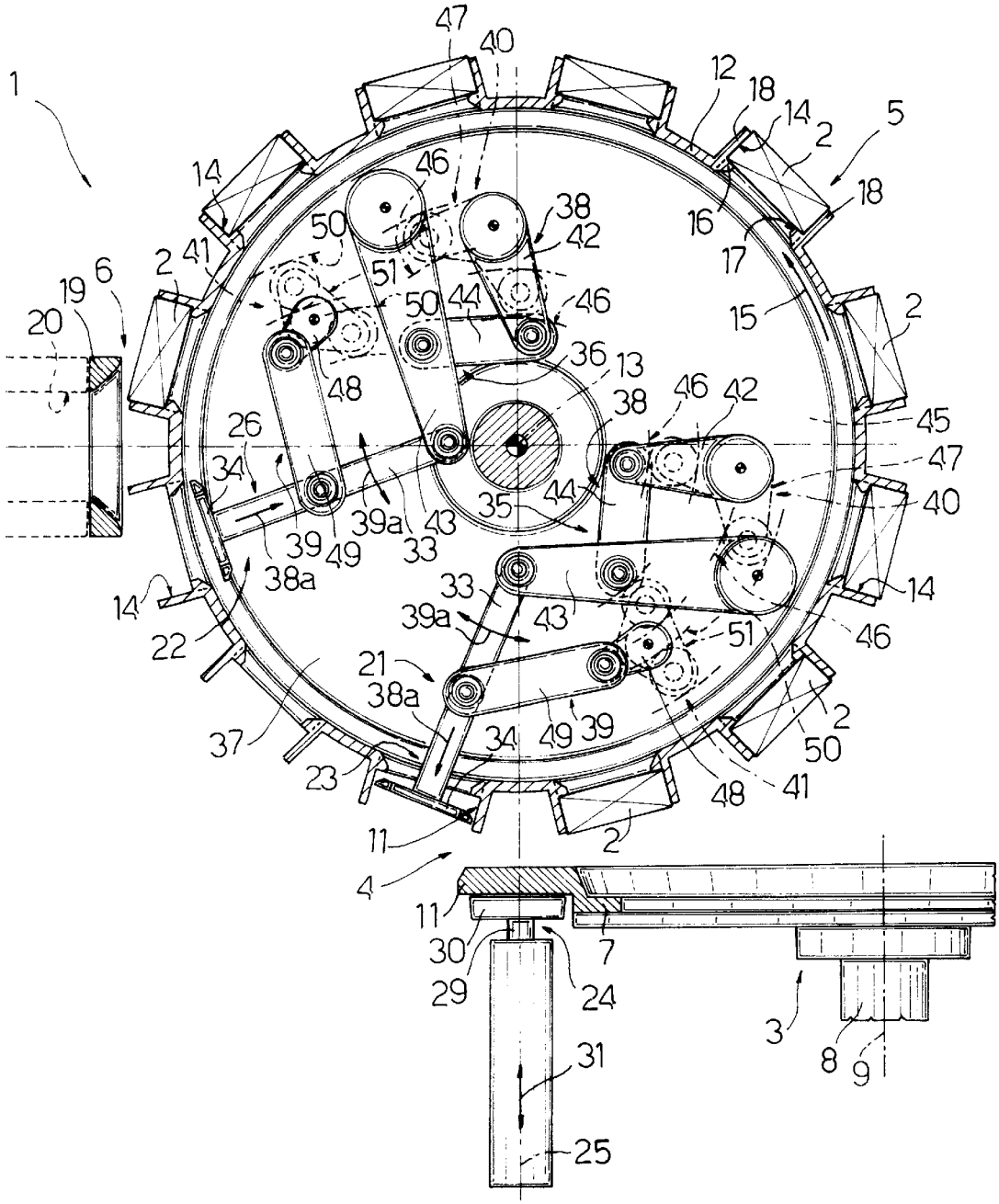

Actuating device 35 is located in the loading station 4 and, starting from the position in which the plate 34 faces the loading station 4, operates as follows. The clockwise rotation of crank 48 determines a clockwise circumferential displacement of plate 34 (FIG. 3). A counterclockwise rotation of crank 42 determines a counterclockwise circumferential displacement of plate 34 simultaneously with a counterclockwise rotation of crank 42 which determines a radial outward displacement of plate 34 (FIG. 4). A clockwise rotation of crank 42 determines a radial inward displacement of plate 34 (FIG. 1). This displacement is defined herein as a work stroke.

Figure 2:
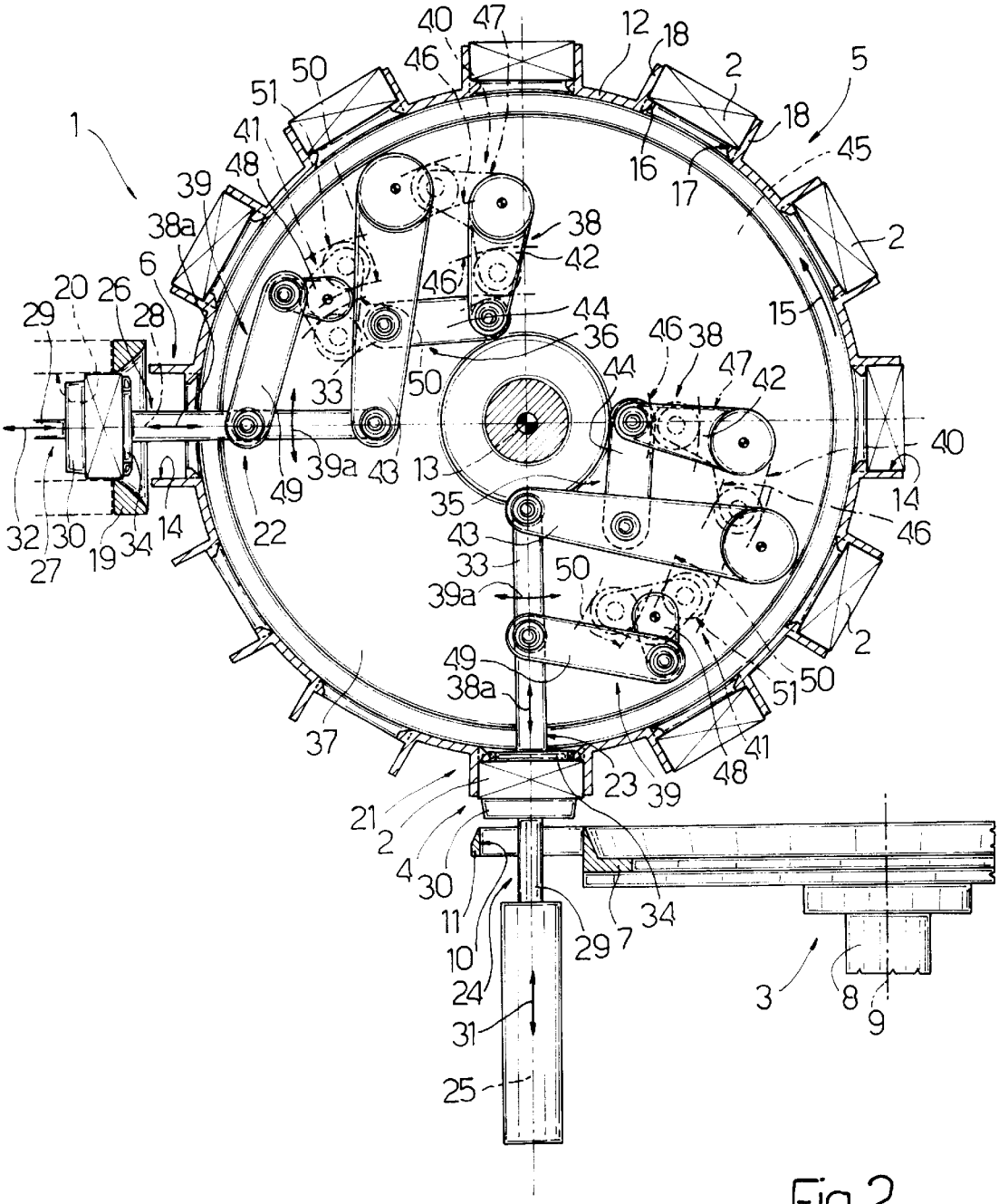
FIGS. 2, 3 and 4 show the same view as in FIG. 1 of the FIG. 1 assembly at further operating stages.

Actuating device 36 is located in the unloading station 6 and, starting from the position in which the plate 34 faces the unloading station 6, operates as follows. Rotation of crank 42 determines a radial outward displacement of plate 34 (FIGS. 1 and 2). This displacement is defined herein as a work stroke. A counterclockwise rotation of crank 48 determines a counterclockwise circumferential displacement of plate 34 as a simultaneous counterclockwise rotation of crank 42 determines a radial inward displacement of plate 34 (FIG. 3). A clockwise rotation of crank 48 then determines a clockwise circumferential displacement of plate 34 (FIG. 4).

The cranks 42, 48 are pivotally mounted on the fixed disc 37 and are pivoted by the respective tappets 47, 51 shown in phantom in the drawings. The tappets 47, 51 follow respective tracks 46, 50 made on cam disc 34. The tracks 46, 50 may operate both actuating devices 35, 36, though the actuating devices 35, 36 have different sequences of displacements, as explained above. This result is achieved by the fact that considering the counterclockwise direction of rotation of the wheel 12 and the cam disc 45, the actuating device 35 features crank 48 arranged upstream of crank 42, whereas the actuating device 36 features crank 48 downstream of crank 42.

Operation of machine 1 will now be described as of the FIG. 1 operating position, in which wheel 12 is stationary, and with reference to only two pockets 14, a first arrested in station 4 and ready to receive a product 2 housed inside a pocket 10 also arrested in station 4, and a second arrested in station 6 and ready to unload a product 2 into channel 20.

As of the above operating position, and while wheel 12 is stationary, disk 45, which rotates uniformly about axis 13, moves tracks 46 and 50 in such a manner as to move rods 33 axially in respective directions 38*a*, and so perform the work strokes of respective plates 34.

More specifically, plate 34 of loading device 21 is moved from the extracted position (FIG. 1) to the withdrawn position (FIG. 2) in unison with plate 30 of pusher 24, so as to transfer a product 2 from pocket 10 to pocket 14, both arrested in station 4. Upon product 2 contacting bottom wall 16 of pocket 14, plate 30 of pusher 24 is arrested and reversed away from wheel 12, while plate 34 continues the work stroke through opening 17 and into wheel 12.

At the same time, plate 34 connected to actuating device 36 is moved, in push-pull manner with respect to plate 34 connected to actuating device 35, from the withdrawn position (FIG. 1) to the extracted position (FIG. 2) in unison with plate 30 of counter-pusher 27, so as to transfer a product 2 from pocket 14, arrested in station 6, into channel 20 through frame 19.

Tracks 46 and 50 are therefore so formed as to determine, during the work stroke of plates 34, a relatively wide angular movement of cranks 42, and substantially no angular movement of cranks 48.

As shown in FIG. 3, as soon as the two plates 34 complete the respective work strokes, wheel 12 starts rotating in direction 15, and devices 35 and 36, still operating in push-pull manner, move counter-pusher 23 and pusher 26 through the respective return strokes, despite the fact that wheel 12 is moving in direction 15. More specifically, in the case of counter-pusher 23, respective tracks 46 (FIG. 3) first determine substantially no angular movement of crank 42, so as to keep respective plate 34 at a substantially constant distance from axis 13, while respective tracks 50 determine a relatively wide angular movement of respective crank 48, so as to reverse respective plate 34, in direction 39*a* and in the opposite direction to direction 15, into a position facing the opening 17 of the next pocket 14 approaching station 4. At this point, plate 34 is reversed, and is moved both by respective element 39 in direction 15 (FIG. 4) and at the same speed as wheel 12, so as to remain aligned with said opening 17, and by quadrilateral 38 in direction 38*a*, so as to reach the extracted position when wheel 12 is arrested and respective rod 33 is again coaxial with radius 25 (FIG. 1).

In the case of pusher 26, respective plate 34 is first moved both by respective element 39 in direction 15 (FIG. 4) and at the same speed as wheel 12, so as to remain aligned with opening 17 of respective pocket 14, and by quadrilateral 38 in direction 38*a*, so as to move gradually into the withdrawn position. Upon plate 34 being housed inside wheel 12, tracks 46 determine substantially no angular movement of respective crank 42, so as to keep plate 34 at a substantially constant distance from axis 13, while respective tracks 50 reverse plate 34 in direction 39*a* and in the opposite direction to direction 15, until respective axis 33 (FIG. 1) is coaxial with radius 28.

Actuating devices 35, 36 and respective devices 40 and 41 therefore enable plates 34, movable through pockets 14, to perform the respective return strokes as wheel 12 moves one step forward, thus substantially halving the downtime of assembly 5.

What is claimed is:

1. A conveying assembly for conveying products, and comprising a conveyor having a number of pockets and moving in steps to feed said pockets along a path extending through a loading station and an unloading station for respectively loading and unloading said products; the assembly also comprising an unloading device and a loading device located respectively at the unloading station and the loading station, to transfer said products from and to said pockets; and the loading and unloading devices comprising respective first push elements movable through said pockets, and respective second push elements each co-operating with one of said respective first push elements, and respective actuating devices for imparting to said first push elements a work stroke and a return stroke; wherein the actuating devices comprise respective drive means for moving the respective push elements back and forth along said path in the course of the respective return strokes, and for activating the push elements in push-pull manner with respect to each other, so as each to cause the respective push element to perform the respective work stroke when the conveyor is arrested between one step and the next, and the respective return stroke when the conveyor is moving with a product being transferred while between respective first and second push elements, each said drive means comprising first actuating means for imparting to the respective first push elements a first movement in a first direction substantially crosswise to said path; and second actuating means for imparting to the respective first push elements a second movement in a second direction substantially parallel to said path.

2. A conveying assembly as claimed in claim 1, characterized in that said path is a path in the form of a loop, said first push elements being located inside said loop.

3. A conveying assembly as claimed in claim 2, characterized in that said first push elements comprise a loading counter-pusher and an unloading pusher.

4. A conveying assembly as claimed in claim 3, characterized in that said second push elements comprise a loading pusher and an unloading counter-pusher, both located outside said loop and for performing respective work strokes substantially in time with said loading counter-pusher and said unloading pusher respectively.

5. A conveying assembly as claimed in claim 3, characterized in that said conveyor comprises a conveying wheel rotating in steps about a central axis and in turn comprising a fixed central frame; said actuating devices being located inside said wheel and being fitted to said fixed frame.

6. A conveying assembly as claimed in claim 1, characterized by comprising a fixed central frame; each said first push element comprising a control rod; and said first and second actuating means of each said actuating device respectively comprising a first and second transmission pivoting on said fixed frame and connected to separate points of the respective said rod.

7. A conveying assembly as claimed in claim 6, characterized in that each said first transmission comprises an articulated quadrilateral, a frame of which comprises said fixed frame; and a first drive device for orienting said quadrilateral with respect to said frame.

8. A conveying assembly as claimed in claim 7, characterized in that said quadrilateral comprises a rocker arm hinged at a first end to said fixed frame and at a second end to a point of the respective said rod.

9. A conveying assembly as claimed in claim 7, characterized in that each said drive device is a cam device comprising a cam movable at a constant angular speed equal to an average angular speed of said pockets along said path.

10. A conveying assembly as claimed in claim 6, characterized in that said second transmission comprises a crank and a connecting rod, and a second drive device for rotating the crank with respect to said frame.

11. A conveying assembly as claimed in claim 10, characterized in that said connecting rod is hinged at one end to a point of the respective said rod.

12. A conveying assembly for conveying products, and comprising a conveyor having a number of pockets and moving in steps to feed said pockets along a path extending through a loading station and an unloading station for respectively loading and unloading said products; the assembly also comprising an unloading device and a loading device located respectively at the unloading station and the loading station, to transfer said products from and to said pockets; and the loading and unloading devices comprising respective push elements movable through said pockets, and respective actuating devices for imparting to said push elements a work stroke and a return stroke; wherein the actuating devices comprise respective drive means for moving the respective push elements back and forth along said path in the course of the respective return strokes, and for activating the push elements in push-pull manner with respect to each other, so as each to cause the respective push element to perform the respective work stroke when the conveyor is arrested between one step and the next, and the respective return stroke when the conveyor is moving;

each said drive means comprises first actuating means for imparting to the respective push element a first movement in a first direction substantially crosswise to said path; and a second actuating means for imparting to the respective push element a second movement in a second direction substantially parallel to said path;

a fixed central frame; each said push element comprising a control rod; and said first and second actuating means of each said actuating device respectively comprising a first and second transmission pivoting on said fixed frame and connected to separate points of the respective said rod.

13. A conveying assembly as claimed in claim 12, characterized in that each said first transmission comprises an articulated quadrilateral, a frame of which comprises said fixed frame; and a first drive device for orienting said quadrilateral with respect to said frame.

14. A conveying assembly as claimed in claim 13, characterized in that each said drive device is a cam device comprising a cam movable at a constant angular speed equal to an average angular speed of said pockets along said path.

15. A conveying assembly as claimed in claim 13, characterized in that said quadrilateral comprises a rocker arm hinged at a first end to said fixed frame and at a second end to a point of the respective said rod.

16. A conveying assembly as claimed in claim 12, characterized in that said second transmission comprises a crank and a connecting rod, and a second drive device for rotating the crank with respect to said frame.

17. A conveying assembly as claimed in claim 16, characterized in that said connecting rod is hinged at one end to a point of the respective said rod.

* * * * *

UNITED STATES PATENT AND TRADEMARK OFFICE

CERTIFICATE OF CORRECTION

PATENT NO. : 6,112,881

DATED : September 5, 2000

INVENTOR(S) : Robert Osti & Fiorenzo Draghetti

It is certified that error appears in the above-identified patent and that said Letters Patent is hereby corrected as shown below:

On the cover page of the patent, item [73], the Assignee should be corrected to read as follows: G.D Societa' Per Azioni.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*